United States Patent [19]

Waxman

[11] 4,189,319

[45] Feb. 19, 1980

[54] ARGININE OR SALT THEREOF AS A DEVELOPMENT ACCELERATOR OF COLOR DEVELOPMENT OF COLOR PHOTOGRAPHIC MATERIALS

[75] Inventor: Burton H. Waxman, Endwell, N.Y.

[73] Assignee: GAF Corporation, New York, N.Y.

[21] Appl. No.: 597,225

[22] Filed: Jul. 18, 1975

[51] Int. Cl.[2] ..... G03C 7/16; G03C 7/00; G03C 5/30; G03C 1/06

[52] U.S. Cl. ..... 430/380; 430/382

[58] Field of Search ..... 96/66.3, 107, 55, 56.5, 96/22, 95

[56] References Cited

U.S. PATENT DOCUMENTS

| | | | |
|---|---|---|---|
| 2,164,687 | 7/1939 | Nassau | 96/66.3 |
| 2,304,025 | 12/1942 | Schneider et al. | 96/56.2 |
| 2,454,001 | 11/1948 | Mueller | 96/55 |
| 2,496,903 | 2/1950 | Wasley | 96/66.3 |
| 3,190,752 | 6/1965 | Hayakawa et al. | 96/107 |
| 3,615,529 | 10/1971 | Tajima et al. | 96/95 |

OTHER PUBLICATIONS

Photographic Science & Engineering, vol. 6, No. 5, Sep.-Oct. 1962, by Miura et al., pp. 272-275.

*Primary Examiner*—Mary F. Kelley

[57] ABSTRACT

Arginine or an acid addition salt thereof is used as a development accelerator in the color development of color photographic materials, either in the color developer bath or in the color photographic material.

13 Claims, 3 Drawing Figures

ARGININE OR SALT THEREOF AS A DEVELOPMENT ACCELERATOR OF COLOR DEVELOPMENT OF COLOR PHOTOGRAPHIC MATERIALS

This invention relates to a development accelerator to increase the speed of a photographic silver halide emulsion without a significant increase in fog.

Development accelerators are in widespread use, but a primary disadvantage that they share is the increase in fog that accompanies the increase in speed. One system that often requires a development acceleration is a photographic silver halide emulsion containing no iodide or less than 1 mol % iodide, which is commonly used in color print material, e.g. color printing paper. Color printing paper has a short development time and hence often requires acceleration, but this acceleration cannot be accompanied by any significant increase in fog. Other color development systems can also benefit from development acceleration.

It is thus an object of the invention to provide a development accelerator for use in color development of a photographic silver halide emulsion with a photographic color developer.

This is accomplished by the present invention by carrying out the color development of an exposed photographic silver halide emulsion with a color developer in the presence of arginine or salt thereof as a development accelerator. The arginine or salt thereof may be in a processing solution or incorporated in the photographic material.

Arginine has previously been proposed as a development accelerator for black and white photographic material, especially lithographic film, using a hydroquinone-formaldehyde developer of the D-85 type. See Miura et al, "Development-Accelerating Effect of Arginine," Photographic Science and Engineering, Vol. 6, Pp. 272–275, 1962. U.S. Pat. No. 3,615,529 proposes the use of arginine in a rapid development process wherein the developer is incorporated in a photographic silver halide emulsion, but here again the developing agent included hydroquinone or a derivative thereof. In both cases, the development acceleration was attributed to a reaction of the arginine with the hydroquinone-semiquinone and was felt to be specific for the hydroquinone black and white type developer. U.S. Pat. No. 3,288,612 also deals with the use of arginine with a hydroquinone-formaldehyde developer, but in a high contrast black and white photographic system.

It has now been found that development by a color developer can be accelerated by the use of arginine or an acid additon salt thereof, without significant increase in fog. Since the color developers do not give rise to the hydroquinone-semiquinone that was deemed by the art to be the basis for the development accelerating effect of arginine in hydroquinone developer systems, it is decidedly unexpected that arginine would have a development accelerating effect in color photographic development processes.

The present invention is illustrated by the accompanying drawing, in which.

Figure 2:
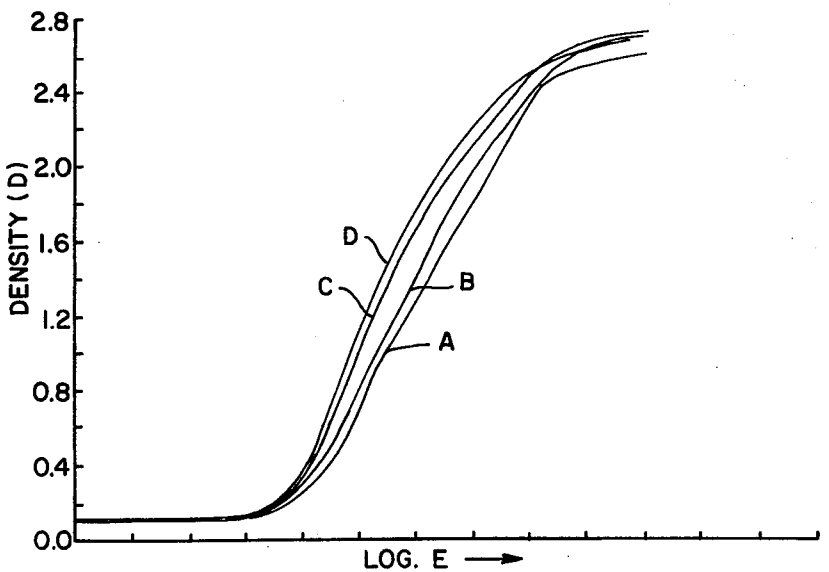
FIG. 2 shows the characteristic curve for a green sensitive silver halide emulsion developed with a developer solution containing from 0 to 3.5 g/liter of arginine.

The development acceleration effect of arginine according to the invention is realized with any gelatin silver halide emulsion containing up to 1 mol percent iodide, such as silver chloride, silver bromide, silver chlorobromide, silver bromide containing up to 1 mol percent iodide, and silver chlorobromide containing up to 1 mol percent iodide. Any acid addition salt of arginine may be employed, such as arginine hydrochloride, arginine carbonate, arginine sulfate, etc., since the salt dissociates into arginine in the developing bath, and thus the desired effect is achieved.

Any color developer, such as the paraphenylene diamine color developers, can be used. While paraphenylene diamine color developers are customarily employed in the developer bath, the paraphenylene diamine color developers of Waxman et al, Ser. No. 531,399, filed Dec. 10, 1974 may be incorporated into the photographic emulsion and used in the present invention.

Color negative and color reversal photographic materials may be used, the photographic support carrying the emulsion being opaque or translucent for color print material or transparent for color film material. The photographic emulsion or a processing solution may contain the color coupler that reacts with the oxidized color developer during development in the presence of arginine or salt thereof to form a coupled product. The color coupler may be any of those known in the art, such as the Fischer couplers. As is known, the couplers may be colored or colorless, diffusible or non-diffusible through the photographic emulsion during development, and are selected to provide a coupled product of desired hue.

The photographic emulsion may also contain the usual chemical sensitizers, anti-foggants and other additives customarily employed. Likewise, the developer bath will be prepared in the normal fashion, whether the arginine or salt thereof is in the developer bath or the photographic emulsion, and will be at the pH normally used for a given developer and will contain any of the usual additives.

Development in the presence of arginine will proceed in the conventional manner for a given photographic emulsion/color developer system. If the development time used is the same with the arginine as without it, an increase in speed will be obtained. Alternatively, the development time can be reduced when development occurs in the presence of arginine, to obtain the same speed as in the case where no arginine is employed. Development time for a system using arginine or salt thereof in the photographic emulsion or in the development bath is empirically determined for a given photographic emulsion/color developer system using well known techniques.

After development, the photographic material is fixed, washed and dried as with a conventional system.

Whether the arginine or salt thereof is used in the developer bath or is incorporated in the photographic material, an amount is used sufficient to accelerate development. An amount of up to about 0.06 mols per liter of developer solution has been found to be satisfactory, with an amount of from about 0.0025 to about 0.06 mols per liter of arginine or salt thereof being preferred. At a level of from about 0.0025 to about 0.02 mols of arginine or salt thereof per liter of solution, any increase in fog is minimized.

Where the arginine or salt thereof is incorporated in the photographic material, an amount of up to about 0.13, preferably from about 0.006 to about 0.13, most preferably from about 0.006 to about 0.05 mols of arginine or salt thereof per mol of silver in the photographic emulsion may be used. The arginine or salt thereof may be coated with the emulsion as an additive thereto or can be coated from an aqueous solution over the emulsion. Where there is more than one photographic silver halide emulsion present, such as in the usual case where the photographic material has three photographic silver halide emulsions, each sensitized to a different primary color, one, two or all three of the emulsions may contain the arginine or salt thereof, or there may be a separate layer containing the arginine or salt thereof, since the arginine or salt thereof will diffuse during development and will hence be available for all emulsions in the photographic material.

Where the development acceleration effect of arginine or salt thereof is accompanied by an unacceptable increase in fog for a given system, either the amount of arginine or salt thereof can be reduced or a restrainer can be used, such as in the developer bath. Suitable restrainers include bromide ion, a mercapto compound, a compound of the benzimidazole, benzotriazole, benzothiazole, tetrazole an thiazole series, an anthraquinone sulfonic acid salt, or any other known anti-foggant.

The present invention is illustrated by the following Examples. All parts and proportions referred to herein and in the appended claims are by weight, unless otherwise specified.

EXAMPLE 1

A series of commercial color print papers containing blue, green and red sensitive silver halide emulsions coated on a resin-coated paper support were successively exposed with red, green and blue light through a step wedge and successively developed by immersion in a developer bath containing a paraphenylene diamine color developer and from 0.5 to 10.0 grams per liter of arginine, and in a control developer bath containing no arginine. Each development was at pH 10.1, a temperature of 85° F. and a development time of 3.5 minutes. The blue sensitive emulsion was a gelatino silver bromide emulsion (99.52 mol % Br, 0.48 mol % I) containing a lipophilic benzoylacetanilide coupler; the green sensitized emulsion was a gelatino silver chlorobromide emulsion (53 mol % Cl, 47 mol % Br) containing a lipophilic pyrazolone coupler; and the red sensitized emulsion was a gelatino silver chlorobromide emulsion (53 mol % Cl, 47 mol % Br) containing a lipophilic phenolic coupler. The increase in speed and the fog level of each sample as compared to the control is reported in the Table below.

Table

| Arginine In Developer Bath (g/l) | Increase in speed and fog level for red, blue and green sensitive gelatine silver halide emulsions — Emulsion: Blue Δ Speed | Blue Fog | Green Δ Speed | Green Fog | Red Δ Speed | Red Fog |
|---|---|---|---|---|---|---|
| 0 | — | 0.14 | — | 0.10 | — | 0.10 |
| 0.5 | + 0.05 | 0.14 | + 0.05 | 0.11 | + 0.08 | 0.11 |

Table-continued

| Arginine In Developer Bath (g/l) | Increase in speed and fog level for red, blue and green sensitive gelatine silver halide emulsions — Emulsion: Blue Δ Speed | Blue Fog | Green Δ Speed | Green Fog | Red Δ Speed | Red Fog |
|---|---|---|---|---|---|---|
| 1.5 | + 0.05 | 0.12 | + 0.10 | 0.12 | + 0.15 | 0.12 |
| 3.5 | + 0.08 | 0.15 | + 0.15 | 0.11 | + 0.18 | 0.10 |
| 5.0 | + 0.21 | 0.15 | + 0.41 | 0.12 | + 0.37 | 0.12 |
| 10.0 | + 0.33 | 0.19 | + 0.60 | 0.15 | + 0.57 | 0.16 |

The value for Δ speed is reported as the difference between Log E at D equals 0.7 units above fog for the test sample and for the control.

Figure 3:
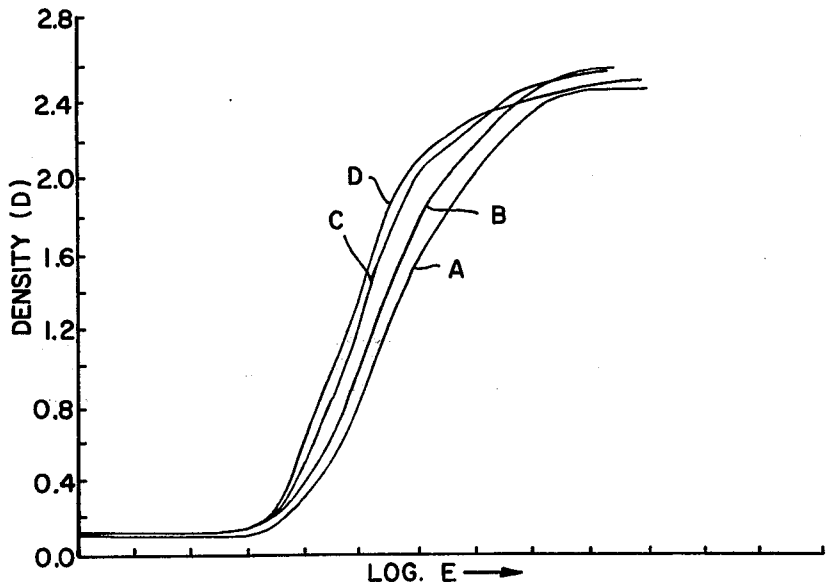
FIG. 3 shows the characteristic curve for a red sensitive silver halide emulsion developed with a developer solution containing from 0 to 3.5 g/liter of arginine.
Figure 1:
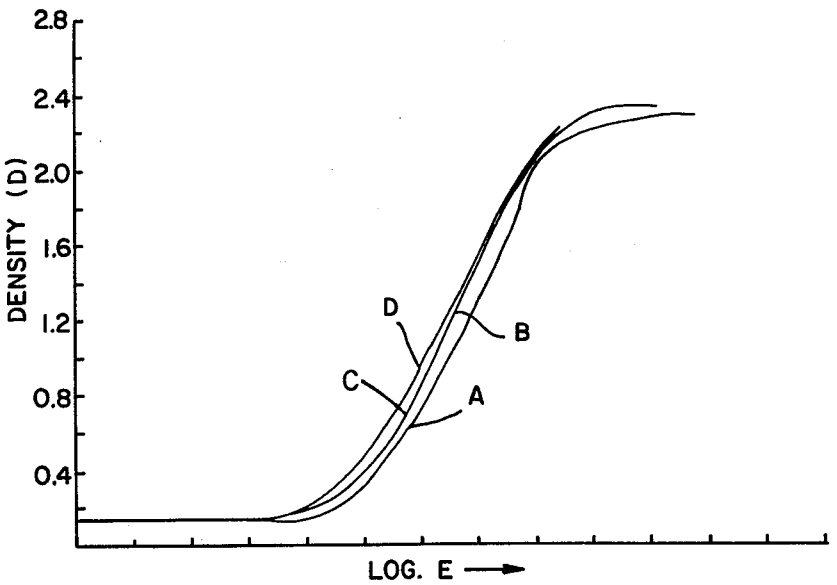
FIG. 1 shows the characteristic curve for a blue sensitive silver halide emulsion developed with a developer solution containing from 0 to 3.5 g/liter of arginine.

Characteristic curves for the three emulsions appear in FIGS. 1–3, wherein for each Figure, curve A is the control, i.e. no arginine in the developer bath, and curves B, C and D are for emulsions developed in a developer bath containing 0.5, 1.5 and 3.5 g/l of arginine, respectively.

EXAMPLE 2

A color print paper containing arginine in each emulsion layer was prepared by coating the blue-, green- and red-sensitive silver halide emulsions described in Example 1 in a conventional manner but with 0.044 mols of arginine per mol of silver in the emulsion as an additive to each emulsion. The print paper thus obtained was exposed and developed with a paraphenylene diamine color developer as described in Example 1 with similar results, namely an increase in speed with no significant increase in fog as compared to an otherwise identical color print paper containing no arginine.

What is claimed is:

1. A process for color development of a photographic element comprising a light-sensitive multi-layer photographic silver halide emulsion that has been exposed to actinic radiation, which comprises treating the exposed silver halide emulsion with a processing solution comprising a photographic color developer in the presence of a color coupler reactive with oxidized color developer to form a coupled product and arginine or a salt thereof in an amount effective to accelerate development.

2. The process according to claim 1, wherein said arginine or salt thereof is in said processing solution in an amount of from about 0.0025 to about 0.006 mols per liter of said processing solution.

3. The process according to claim 1, wherein said arginine or salt thereof is incorporated in said photographic element in an amount of from about 0.006 to about 0.13 mols per mol of silver in said photographic material.

4. The process according to claim 1, wherein the color coupler is in said processing solution.

5. The process according to claim 1, wherein the color coupler is incorporated in said photographic element.

6. The process according to claim 1, wherein said photographic element is a color negative or reversal photographic material having at least one photographic silver halide emulsion sensitized to a primary color.

7. The process according to claim 1, wherein said photographic element is a color print material having at least one photographic silver halide emulsion containing up to 1 mol percent iodide sensitized to a primary color carried on an opaque or translucent photographic support.

8. The process according to claim 2, wherein said arginine or salt thereof is in an amount of from about 0.0025 to about 0.02 mols per liter of said processing solution.

9. The process according to claim 3, wherein said arginine or salt thereof is in an amount of from about 0.006 to about 0.05 mols per mol of silver in said photographic material.

10. A color photographic material, comprising photographic material, comprising at least one photographic silver halide emulsion sensitized to a primary color, a color coupler reactive with oxidized color developer to form a coupled product, and arginine or a salt thereof in an amount of from about 0.006 to about 0.13 mols per mol of silver in said photographic material.

11. The photographic material according to claim 10, which is a color negative or reversal photographic material having at least one photographic silver halide emulsion sensitized to a primary color.

12. The photographic material according to claim 10, which is a color print material having at least one photographic silver halide emulsion containing up to 1 mol percent iodide sensitized to a primary color carried on an opaque or translucent photographic support.

13. The photographic material according to claim 10, wherein said arginine or salt thereof is in an amount of from about 0.006 to about 0.05 mols per mole of silver in said photographic material.

* * * * *

Disclaimer 4,189,319.—*Burton H. Waxman,* Endwell, N.Y. ARGININE OR SALT THEREOF AS A DEVELOPMENT ACCELERATOR OF COLOR DEVELOPMENT OF COLOR PHOTOGRAPHIC MATERIALS. Patent dated Feb. 19, 1980. Disclaimer filed Sept. 30, 1982, by the assignee, *Eastman Kodak Co.*

Hereby enters this disclaimer to all claims of said patent.

[*Official Gazette March 1, 1983.*]